US006062147A

United States Patent [19]

Footitt et al.

[11] Patent Number: 6,062,147

[45] Date of Patent: May 16, 2000

[54] ROLLER ASSEMBLY, TABLE ASSEMBLY, AND MODESTY SCREEN

[75] Inventors: Ian Footitt, Lower Hutt; Michael Edward Keogh, Wellington; Neil Robertson Herriot; Bob Stewart, both of Lower Hutt, all of New Zealand

[73] Assignee: Formway Furniture Limited, Wellington, New Zealand

[21] Appl. No.: 09/228,321

[22] Filed: Jan. 11, 1999

[30] Foreign Application Priority Data

Jan. 13, 1998 [NZ] New Zealand ..... 329574

[51] Int. Cl.[7] ..... A47B 57/00

[52] U.S. Cl. ..... 108/60; 108/50.01; 160/262

[58] Field of Search ..... 108/60, 61, 50.01, 108/50.02; 160/262

[56] References Cited

U.S. PATENT DOCUMENTS

| | | | |
|---|---|---|---|
| 456,200 | 7/1891 | Maxedon | 160/262 |
| 516,018 | 3/1894 | Lauer | 160/262 |
| 740,920 | 10/1903 | Rees et al. | 160/262 X |
| 3,117,534 | 1/1964 | Martland | 108/60 |
| 4,827,850 | 5/1989 | Diffrient | 108/60 |
| 5,067,546 | 11/1991 | Jeuffray et al. | 160/262 X |
| 5,201,810 | 4/1993 | Ojima et al. | 160/265 |
| 5,353,715 | 10/1994 | Luyk | 108/116 |
| 5,394,809 | 3/1995 | Feldpausch et al. | 108/144 |
| 5,483,903 | 1/1996 | Pierce et al. | 108/147 |
| 5,673,632 | 10/1997 | Sykes | 108/50.02 X |
| 5,752,449 | 5/1998 | Simon et al. | 108/50.02 |

FOREIGN PATENT DOCUMENTS

| | | |
|---|---|---|
| 2 648 505 | 6/1989 | France . |
| 197 22 772 A1 | 12/1998 | Germany . |

*Primary Examiner*—Jose V. Chen
*Attorney, Agent, or Firm*—Workman, Nydegger & Seeley

[57] ABSTRACT

A roller assembly (12) for a screening assembly (10) includes a non-linear axle (30) and a flexible sleeve assembly (32) rotatable about the axle (30). A table assembly (40) includes a table surface (42) which is adjustable in height over a range of height positions and a screen (14) extendable below the table surface (42). The screen (14) is adjustable with the height adjustment of the table surface (42). A modesty screen (10) for a height adjustable table (40) has first and second relatively movable portions (44,46). The modesty screen (10) includes a screen (14) and a retraction unit (16) such that the screen (14) may be retracted and extended. The retracting unit (16) is adapted for attachment to the first portion (44) of the table (40) and the screen (14) is adapted for attachment to the second portion (46) of the table (40).

17 Claims, 3 Drawing Sheets

ROLLER ASSEMBLY, TABLE ASSEMBLY, AND MODESTY SCREEN

This application claims priority under 35 U.S.C. §119 to New Zealand Patent Application No. 329,574, filed Jan. 13, 1998, which application is incorporated herein by specific reference.

BACKGROUND OF THE INVENTION

1. The Field of the Invention

The present invention relates to a screening assembly. In particular, although not exclusively, the invention relates to a screening assembly for use with a height adjustable table to provide decency for a user sitting at the table by ensuring that the user is not viewed from a compromising viewpoint. The invention also resides in a curved roller-type blind which is in no way limited for use as a modesty screen for a table. It will be appreciated that a roller-blind made in accordance with the present invention may be used in connection with curved windows in domestic dwellings or motor vehicles, for example.

2. Present State of the Art

Modesty panels have long been used in conventional tables, particularly desks to provide decency for the nether regions of an occupant seated at the desk. The modesty panel is an upright panel extending across the front of the desk opposite the side at which the user would normally be seated. Complications arise when modesty panels are to be used in connection with height adjustable desks. If the desk surface is to move through an appreciable height range and the modesty panel moves with the desk surface, it will be appreciated that for the modesty panel to be effective through the entire height range, then the modesty panel will be fairly close to the floor when the desk surface is located at the lower end of the range. This will generally cause an obstruction to leg movement of the user and as such be in contravention of furniture industry standards.

On the other hand, if the modesty panel is to be secured to the portion of the height adjustable desk remaining stationary relative to the floor, then a gap will be created between the desk surface and the top of the modesty panel as the desk surface is moved to an upper height position. U.S. Pat. No. 5,394,809 discloses such an arrangement in which the modesty panel is secured by brackets to the lower stationary portion of the table support and thus suffers from this disadvantage.

U.S. Pat. No. 5,353,715 discloses a height adjustable folding table. The modesty panel is pivotally mounted to the underside of the table top. The modesty panel therefore has only two operating positions, namely adjacent the table top and extending perpendicularly from the table top. Thus, this arrangement does not provide a range of positions at which the modesty panel can be disposed, such that the modesty panel may be functional through the entire operating range of the height adjustable table. Furthermore, while the modesty panel disclosed does provide a measure of adjustment, the modesty panel must be manually moved between its two operating positions.

Further complications arise in height adjustable tables where the front side of the table opposite to the user is curved or otherwise non-linear in shape. In general, problems arise in providing screens for use in connection with curved openings. U.S. Pat. No. 5,201,810 discloses a roller shade for an opening such as a rear window of an automobile. The shade is drawn from a straight roller but the pull rod may be intentionally bent to a varying degree, depending upon the extent that the shade has been extended from the roller. While this may provide an adequate solution for rear automobile windows, it is considered that such a shade is inappropriate for a window or opening which has a uniform degree of curvature throughout its height.

U.S. Pat. No. 5,067,546 discloses a roller blind having a straight roller disposed in a housing with a curved guide slot so that the drawn-out blind is curved in configuration. It will be appreciated that such an arrangement is not appropriate for a long roller blind since in a long blind, the deviation between the roller and the guide slot at the extremities will lead to difficulties in locating the housing as well as cause rolling problems for the blind. Thus, such an arrangement is generally only suitable for short roller lengths.

OBJECTS AND BRIEF SUMMARY OF THE INVENTION

It is an object of at least one aspect of the invention to provide a roll-type screening assembly which is adapted for an opening having a non-linear boundary or to at least provide the public with a useful choice.

It is therefore an object of at least one aspect of the invention to provide a height adjustable table or a modesty screen for a height adjustable table which overcomes or at least ameliorates some of the above-mentioned disadvantages or to provide the public with a useful choice.

In accordance with a first aspect of the present invention there is provided a roller assembly for a screening assembly including a non-linear axle and a flexible sleeve assembly rotatable about the axle.

Suitably the roller assembly is such that the screening assembly is retractable and extendible as with conventional roller blinds. The roller assembly may be biased into the retracted configuration by a biasing device.

The flexible sleeve assembly will suitably be constructed so as to adopt the non-linear configuration of the axle as well as to bend or adapt to the changing degrees of curvature as the sleeve assembly rotates around the axle. To meet this criteria, the flexible sleeve assembly may be comprised of a unitary sleeve constructed of very pliant material such as sponge-like material. Alternatively, the sleeve assembly may comprise a unitary sleeve with slits or grooves defining sleeve portions and hence allowing relative movement of the sleeve portions. In a most preferred form of the invention the sleeve may be corrugated with each groove defining the corrugations extending circumferentially about the internal and/or external surface of the sleeve. Each corrugation may extend perpendicular to the axis of the non-linear axle such that the corrugations define rings along the flexible sleeve.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

In order that the invention may be more fully understood, the invention will now be described by way of example only with reference to the drawings in which.

DETAILED DESCRIPTION OF THE PREFERRED EMBODIMENTS

Figure 1:
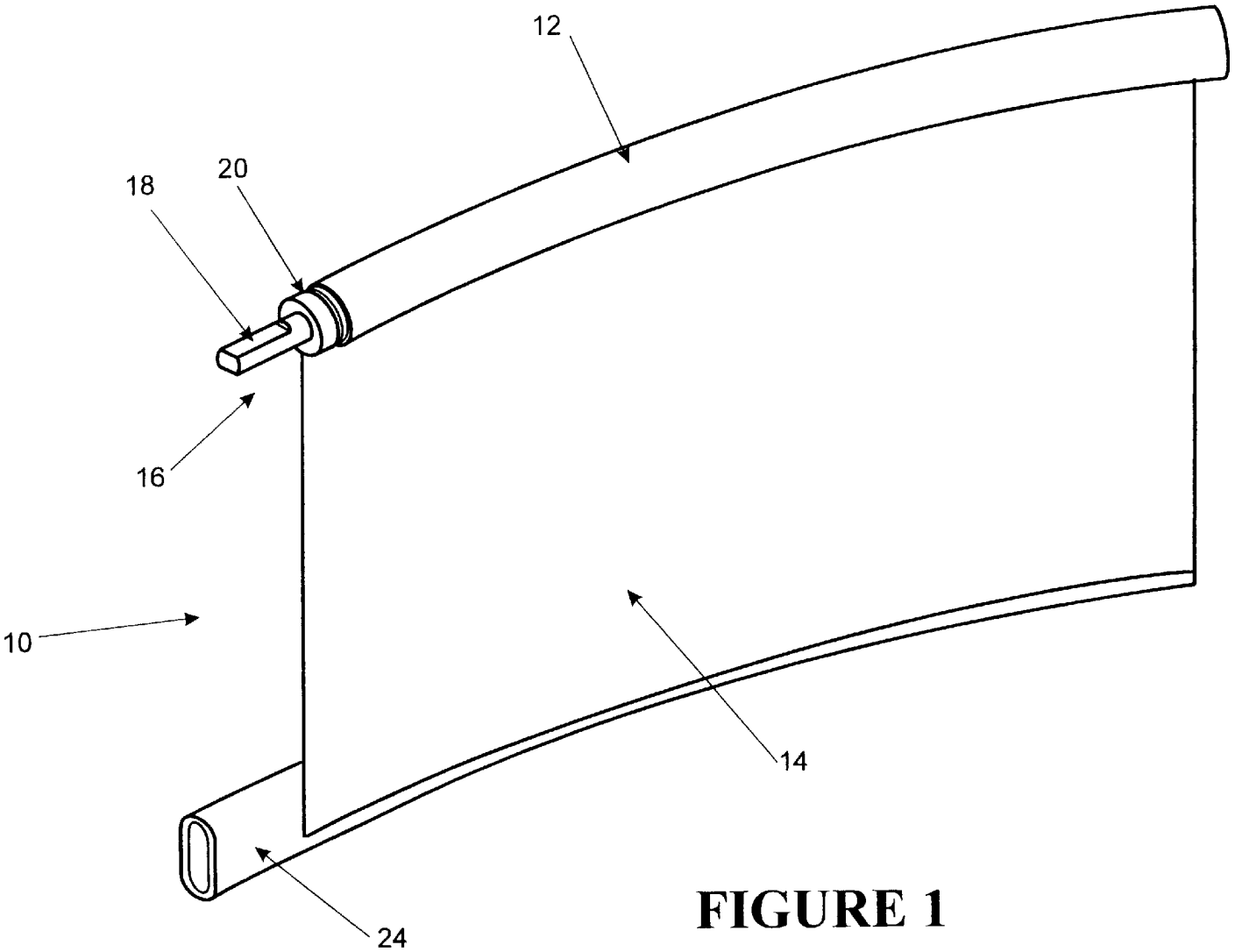
FIG. 1 is perspective view of a screening assembly in accordance with a preferred embodiment of present invention.

The screening assembly 10 comprises a roller assembly 12 of curved configuration. Screening material 14 is wound around the roller assembly 12. Each end of the roller assembly 12 (although only one such end is shown) is provided with retracting unit 16 which will be explained in more detail in connection with FIG. 2. A mounting bar 18 extends from each end of the roller assembly 12. A closure 20 forms part of the retracting unit 16. The ends of the mounting bar 18 extend from a respective closure 20. Each mounting bar 18 is adapted for insertion into an associated mounting bracket 48 (see FIG. 3). The mounting bracket 48 may be of a conventional form as used with conventional roller blind assemblies. One or both of the mounting bars 18 may be provided with a flat as shown to prevent rotation within its associated mounting bracket as will be understood by persons skilled in the art.

Figure 3:
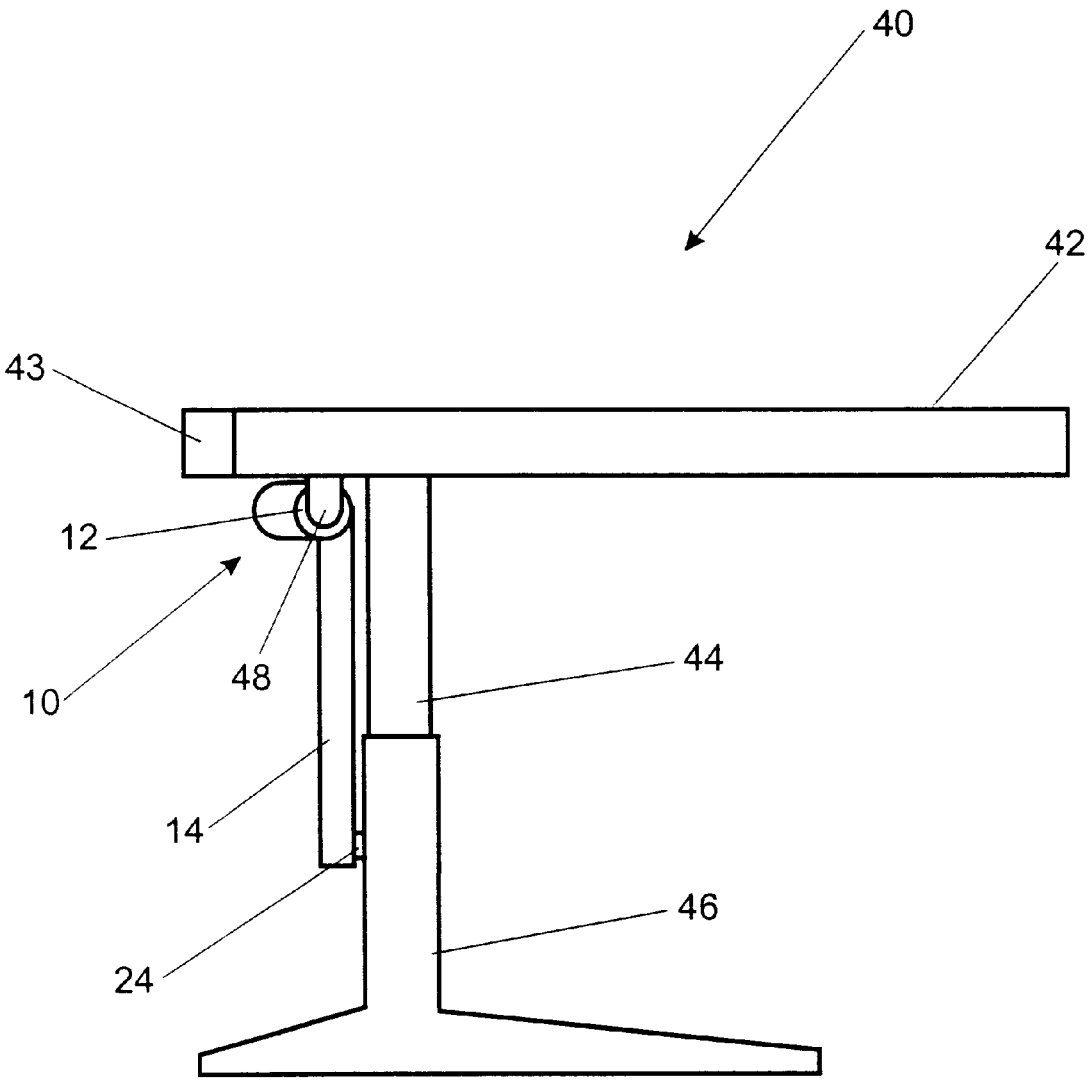
FIG. 3 is a side view of a height adjustable table assembly incorporating the screening assembly shown in FIG. 1.

As shown in FIG. 3, the screening assembly 10 is particularly intended to be mounted on the underside of a height adjustable table 40 to act as a modesty screen for a user seated at the table 40. The table 40 is in the form of a desk having a table top providing a table surface 42. It can be seen that the table top has a front convexly curved portion 43. The table top is mounted to first leg portions 44 (only one of which can be viewed in FIG. 3) of a telescopic leg assembly. The first portions 44 are telescopically received in respective second leg portions 46 (only one of which can be viewed in FIG. 3) of the telescopic leg assembly. The second leg portions 46 are normally stationary relative to the floor. The table surface 42 is height adjustable by sliding the two leg portions 44, 46 relative to one another. Suitably, the table includes a latch to lock the pairs of leg portions 44,46 together. The second portions are joined by a curved rail 24 matching the curvature of the front portion 43 of the table. The curved rail can also be viewed in FIG. 1.

The screening assembly 10 is mounted on the underside of the table top 42 across the front of the table opposite the side at which the user would normally be seated. The curvature of the roller assembly 12 is selected so as to substantially correspond with the frontal curved shape 43 of the table 40.

From FIG. 3, it can be seen that the rail 24 forms part of the lower normally stationary portions of the table. The rail 24 acts as an anchor to the lower end of the screen 14. The screen 14 is attached to the rail 24 by hook and loop fasteners (not shown). It will be appreciated that as the table top 42 is adjusted in height, the roller assembly 10 will move with the table top 42 while the lower end of the screen 14 remains secured to the rail 24. The retracting unit 16 (see FIG. 1) includes a biasing device 36 to bias the screen 14 into the wound-up configuration on the roller assembly 12 to ensure that the screen 14 remains taut and that the screen 14 will automatically roll up when the table top is lowered in height.

Figure 2:
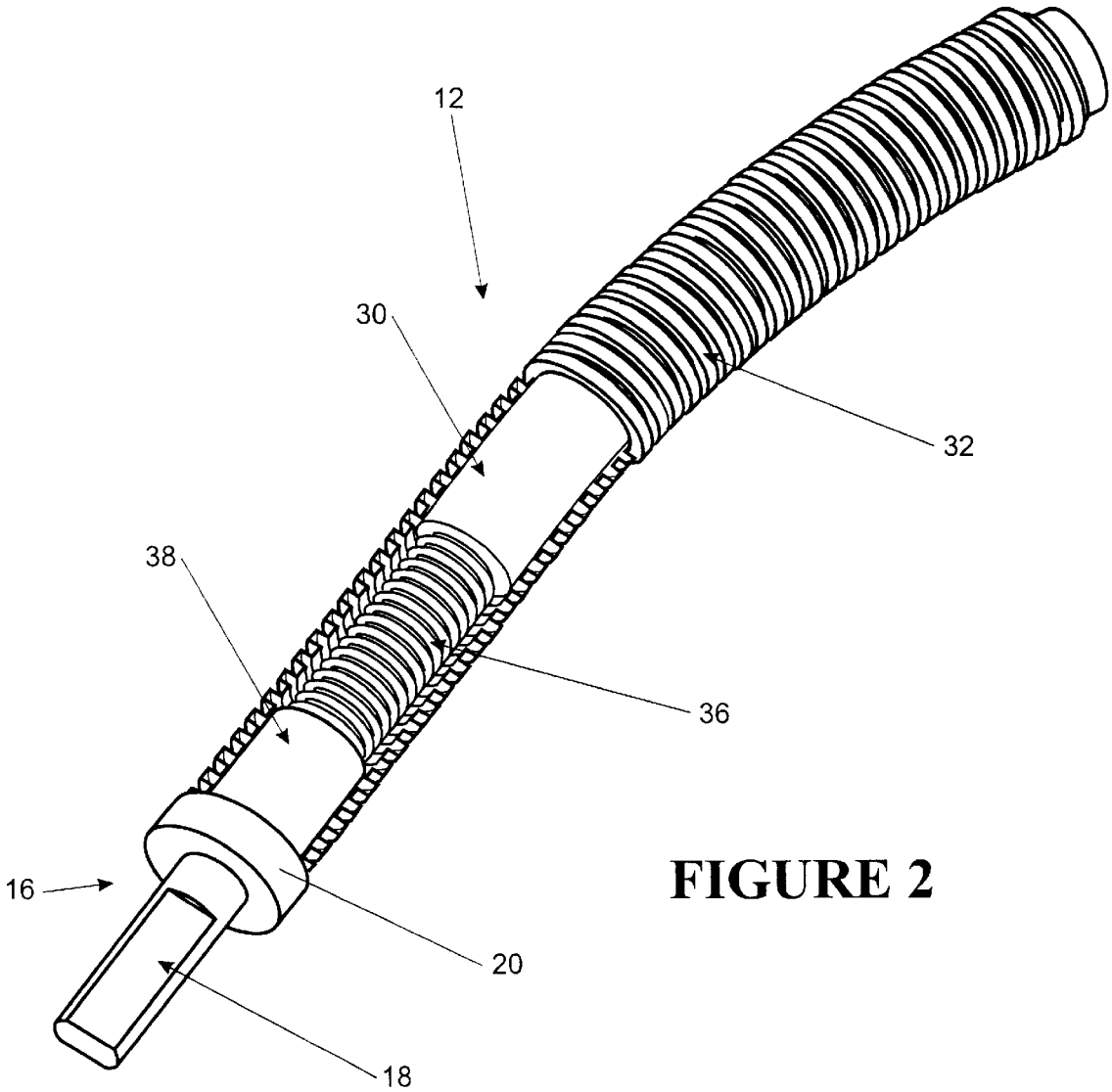
FIG. 2 is partial cut-away perspective view of a roller assembly used in a screening assembly as shown in FIG. 1.

FIG. 2 more clearly illustrates the nature of the roller assembly 12 including the retracting unit 16. The roller assembly 12 comprises a curved axle 30 and a flexible sleeve 32 in the form of a conduit having corrugations extending perpendicularly to the axis of the axle 30. The corrugations assist in making the sleeve flexible to enable the sleeve 32 to rotate on the curved axle 30.

The curved axle 30 terminates some distance from the ends of the flexible sleeve 32. The inner end of the mounting bar 18 is bronze welded into a complementary recess provided at the end of the curved axle 30 thereby defining annular compartments at each end of the flexible sleeve 32. In each compartment extends a spring 36. The spring 36 is connected to the end of the curved axle 30. The other end of the spring 36 is connected to a bush 38 which is glued to the end of the flexible sleeve 32. A closure 20 which is connected to the outermost end of the bush 38 (and may be integral therewith) closes the end of the flexible sleeve 32. The closure 20 is fabricated from nylon to enable the mounting bar 18 to rotate freely within the closure 20.

The upper end of the screen 14 is secured to the flexible sleeve 32 and is wound around the flexible sleeve 32 to form a roller blind in the normal fashion. As the screen 14 is extended from the roller assembly 12, the flexible sleeve 32 is caused to rotate about the curved axle 30. Due to the flexibility of the flexible sleeve 32, the flexible sleeve 32 is able to adapt to the changing curvature during rotation about the curved axle 30. As the flexible sleeve 32 is rotated about the curved axle 30, the retracting assembly including the closure 20 and the bush 38 are also rotated thereby tensioning the spring 36. The spring 36 thereby biases the screen 14 into a retracted configuration.

In an alternative embodiment, the sleeve assembly may comprise a number of discrete sleeve portions interconnected for mutual rotation. Such a configuration may particularly suit a bent axle which is comprised of a number of straight portions, as discussed below.

The non-linear axle may be curved or bent, i.e. comprising a number of straight portions arranged obliquely to each other. Alternatively, the axle may compose a combination of curved and bent portions. The shape may be formed by a process of bending or forging or the shape of the axle may be achieved by casting it in the desired shape. It is preferred that the axle is relatively rigid, sufficient to maintain its curved or bent configuration. Preferably, the axle comprises a steel rod disposed within the flexible sleeve assembly. Advantageously, an easy sliding fit is provided between the axle and the flexible sleeve assembly.

The ends of the axle may be adapted to fit into a mounting bracket, although where the roller assembly is provided with a retracting unit, it is preferred that the retracting unit is associated with each end of the axle. In a preferred embodiment of the retracting unit, each retracting unit includes a spring, one end of which is mounted to the axle, the other being connected to the flexible sleeve to bias the flexible sleeve to rotate in a particular direction relative to the axle which, in the assembled screening assembly corresponds to a retracted position of the blind. In this embodiment, it is preferred that each spring is located within the sleeve, with each end of the sleeve being provided with a closure to facilitate connection of the respective spring to the sleeve. Each axle may be terminated with a pin to engage in a corresponding mounting bracket.

A completed screening assembly would also include a screen which is preferably comprised of pliant sheet material adapted to be wound around the flexible sleeve. The sheet material is preferably a loosely woven fabric. The sheet material may be connected to the flexible sleeve assembly by any appropriate method. For example, the sheet material may be attached with hook and loop fasteners to the flexible sleeve assembly so that the sheet material can be removed from the sleeve assembly for laundering.

The choice of sheet material may depend upon the intended use of the finished screening assembly. For example, if the screening assembly is to be used in a curved window then the sheet material may be translucent fabric or netting. On the other hand, where the screening assembly is adopted for use as a privacy or modesty screen for a desk then preferably, the sheet material will be opaque.

In accordance with a second aspect of the present invention, there is provided a table assembly including a table surface which is adjustable in height over a range of height positions and a screen extending below the table surface wherein the screen is adjustable in extent in the height dimension of the table.

Preferably, a lower edge of the screen remains at a fixed height and the upper edge of the 15 screen is adjustable with the height adjustment of the table surface.

In a preferred form of the invention, there is provided a table assembly including a table surface, first and second relatively movable table portions such that the table surface is adjustable in height and a modesty screen assembly including the screen and having a retracting unit such the screen is retractable and extendable, the retracting unit being mounted to the first portion and an end portion of the screen adapted to be attached to the second portion.

The screen may retract into collapsed or folded configuration. As such, the screen may comprise a concertina or pleated blind. In a more preferred embodiment of the invention, the screen may retract into rolled-up configuration. As such, the screen may comprise a roller blind or roller shutters. In this embodiment, the outermost end of the blind will be adapted for attachment to the second portion. The blind may be comprised of sheet material made of fabric, plastic or other pliable sheet material. Alternatively, the screen may comprise inter-connected slats adapted to be rolled up. The screen is preferably opaque or at the very least translucent to provide effective decency for the user sitting at the table. The modesty screen assembly may comprise a conventional straight assembly providing a substantially planar screen. Alternatively, the modesty screen assembly may utilize a non-linear roller assembly according to the first aspect of the present invention to provide a curved screen.

The table assembly is preferably in the form of a desk or work station designed to accommodate a single worker. The first portion of the table assembly may comprise the table top itself with the second portion comprising a part which is ordinarily stationary relative to the floor such that the retracting unit will be attached to the table top and move as the table surface is adjusted in height. However, the invention is not limited to such an arrangement and it will be appreciated that the retracting unit may be mounted on a portion of the table which is ordinarily stationary relative to the floor with the end portion of the screen attachable to the table top or at least a part of the table assembly movable with the table surface.

The table assembly may incorporate any known height adjustable system. For example, the table top may be connected to a lazy tong assembly which is mounted to a support structure. Alternatively, the table assembly may include a telescopic leg arrangement whereby a first leg portion is secured to the table top and telescopically received by a second leg portion which is normally stationary relative to the floor. In such an arrangement, the retracting unit of the modesty screen assembly is preferably mounted to the underside of the table top or the first leg portion with the outer end portion of the screen being attached to the stationary lower leg portion. Preferably, brackets are provided on the underside of the table top to receive respective ends of the retracting unit.

Preferably, the retracting unit also includes a biasing device to bias the screen into the retracted configuration. In this way, as the table top is raised in height, the screen will extend but yet be held taut by the retracting unit biasing the screen into the retracted configuration. Conversely, as the table top is lowered in height, the screen is automatically collapsed, folded or rolled alleviating the need for separate adjustment by the user.

In accordance with a third aspect of the present invention there is provided a modesty screen assembly for a height adjustable table having first and second relatively movable portions, the modesty screen including a screen and a retracting unit such that the screen is retractable and extendable, the retracting unit being adapted for mounting to the first portion of the table and the screen being adapted to be attached to the second portion of the table.

The modesty screen may include any of the features described in connection with the first and second aspects above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A roller assembly comprising:

(a) an elongated, rigid axle having a non-linear configuration;

(b) a unitary, tubular, corrugated sleeve having an interior surface bounding a passageway longitudinally extending between a first end and an opposing second end, the axle being at least partially longitudinally disposed within the passageway, the corrugated sleeve having a configuration complementary to the non-linear configuration of the rigid axle, the corrugated sleeve being sufficiently flexible to selectively rotate about the axle while maintaining the configuration complementary to the non-linear configuration of the rigid axle;

(c) a flexible screen mounted to the corrugated sleeve, the screen being configured to selectively wrap around the corrugated sleeve; and (d) a biasing device mounted to the axle so as to selectively bias the corrugated sleeve into rotating about the axle.

2. The roller assembly as claimed in claim 1 wherein the biasing device comprises a spring having a first end in connection with the rigid axle and an opposing second end in connection with the corrugated sleeve.

3. The roller assembly as claimed in claim 2 wherein the second end of the spring is coupled to a bush and the bush is connected to the corrugated sleeve.

4. The roller assembly as claimed in claim 1 wherein the flexible sleeve is corrugated along a substantial portion of its length.

5. The roller assembly as claimed in claim 1, wherein the corrugations are disposed at respective associated positions along the axis of the non-linear axle and each corrugation extends perpendicularly to the axis at the associated position.

6. The roller assembly as claimed in claim 1 wherein the non-linear axle is curved.

7. The roller assembly as claimed in claim 1 further comprising:

(a) the axle having a first end and an opposing second end, the first end of the axle being disposed within the passageway of the corrugated sleeve;

(b) a first mounting bar having a diameter smaller than the diameter of the axle, the first mounting bar having a first end coupled with the first end of the axle within the passageway of the corrugated sleeve and an opposing second end projecting out of the first end of the corrugated sleeve; and (c) the biasing device comprising a spring encircling the first mounting bar, the spring having a first end coupled with the first end of the axle and an opposing second end in connection with the corrugated sleeve.

8. The roller assembly as recited in claim 2 wherein the spring comprises a coiled spring.

9. A table assembly comprising:

(a) a table top;

(b) an upper leg assembly mounted to the table top;

(c) a lower leg assembly supporting the upper leg assembly on a floor surface, the upper leg assembly and lower leg assembly being adjustably movable relative to each other so as to enable selective adjustment of the table top relative to the floor; and (d) a roller assembly including:

(i) an elongated axle mounted to a select one of the table top and upper leg assembly;

(ii) a tubular sleeve having an interior surface bounding a passageway longitudinally extending between a first end and an opposing second end, the axle being at least partially disposed within the passageway, the sleeve being selectively rotatable about the axle;

(iii) a flexible screen having a first end mounted to the sleeve and an opposing second end connected to the lower leg assembly; and (iv) biasing means for continuously biasing the sleeve into wanting to rotate about the axle such that the flexible screen automatically wraps and unwraps from around the sleeve as the upper leg assembly is selectively lowered and raised relative to the lower leg assembly.

10. A table assembly as recited in claim 9, wherein the screen is at least partially wrapped around the sleeve.

11. A table assembly as recited in claim 9, wherein the biasing means comprises a spring member in connection with the axle and the sleeve.

12. A table assembly as recited in claim 11, wherein the spring member comprises a coiled spring disposed within the passageway of the sleeve, the coiled spring having a first end in connection with the axle and an opposing second end in connection with the sleeve.

13. A table assembly as recited in claim 9, further comprising:

(a) the axle having a non-linear configuration; and (b) the sleeve having a configuration complementary to the non-linear configuration of the rigid axle, the sleeve being sufficiently flexible to selectively rotate about the axle while maintaining the configuration complementary to the non-linear configuration of the rigid axle.

14. A table assembly as recited in claim 13, wherein the sleeve has corrugations formed substantially along the length thereof, the corrugations circling the sleeve and being disposed at an orientation perpendicular to the longitudinal axis of the sleeve.

15. A table assembly as recited in claim 13, wherein the sleeve has a solid, unitary structure.

16. A table assembly as recited in claim 9, wherein the screen is opaque.

17. A table assembly as recited in 9, wherein the upper leg assembly is slidably disposed within the lower leg assembly.

* * * * *